US006655090B2

(12) United States Patent
Regner

(10) Patent No.: US 6,655,090 B2
(45) Date of Patent: Dec. 2, 2003

(54) VERTICALLY OPENING GATE APPARATUS

(76) Inventor: Cletus Regner, 607 8th Ave. Southwest, Mandan, ND (US) 58554

( * ) Notice: Subject to any disclaimer, the term of this patent is extended or adjusted under 35 U.S.C. 154(b) by 220 days.

(21) Appl. No.: 09/898,525

(22) Filed: Jul. 3, 2001

(65) Prior Publication Data

US 2003/0005637 A1 Jan. 9, 2003

(51) Int. Cl.[7] ..... E05F 1/10
(52) U.S. Cl. ..... 49/386; 49/49
(58) Field of Search ..... 49/49, 226, 385, 49/280, 347, 386

(56) References Cited

U.S. PATENT DOCUMENTS

| | | | | | |
|---|---|---|---|---|---|
| 622,735 | A | * | 4/1899 | Vernon | 49/385 |
| 669,323 | A | * | 3/1901 | Jacobs | 49/142 |
| 896,113 | A | * | 8/1908 | Huffman | 49/328 |
| 1,765,217 | A | * | 6/1930 | Ehlers | 49/105 |
| 1,973,280 | A | * | 9/1934 | Blake | 49/299 |
| 2,044,265 | A | * | 6/1936 | Thomas | 49/106 |
| 4,270,312 | A | * | 6/1981 | Courtis et al. | 49/385 |
| 4,470,221 | A | * | 9/1984 | Courtis | 49/385 |
| 4,481,737 | A | * | 11/1984 | Rebhan et al. | 49/385 |
| 4,658,543 | A | * | 4/1987 | Carr | 49/139 |
| 4,779,379 | A | * | 10/1988 | Steen | 49/385 |
| 4,881,345 | A | | 11/1989 | Cysewski | |
| 4,887,393 | A | * | 12/1989 | Cysewski | 49/385 |
| 4,986,031 | A | * | 1/1991 | Agnew et al. | 49/385 |
| 5,131,187 | A | | 7/1992 | Agnew et al. | |
| 5,263,281 | A | * | 11/1993 | Osborn | 49/280 |
| 5,440,838 | A | | 8/1995 | Lesser | |
| 6,009,670 | A | * | 1/2000 | Howard | 49/340 |
| 6,135,190 | A | * | 10/2000 | Gompertz et al. | 160/328 |

* cited by examiner

*Primary Examiner*—Gregory J. Strimbu
(74) *Attorney, Agent, or Firm*—Curtis V. Harr

(57) ABSTRACT

A framed gate pivotally mounted at one of it's lower corners to an inner fence post securely positioned in the ground. The pivotal mounting of the gate allows one end of the gate to swing up and out of the way thereby effectively opening a gap and allowing passage from one side of the fence line to the other. A primary post is positioned outside of the inner fence post in relation to the gate. A manual winch device or powered winch device is attached to the primary post for the lifting of the framed gate. Further, this device is equipped with a spring for assisting the swinging of the gate up and out of the way and may be equipped with a remote control mechanism for remote operation of the gate. On the opposite side of the gate from the inner post is located the outer post which contains a catch mechanism to engage a locking mechanism on the gate to securely lock and hold the gate in a closed position.

20 Claims, 7 Drawing Sheets

10
12
14
16
18
20
22
24
26
28
30
32
34
36
38
40
42
44
64

FIG 5
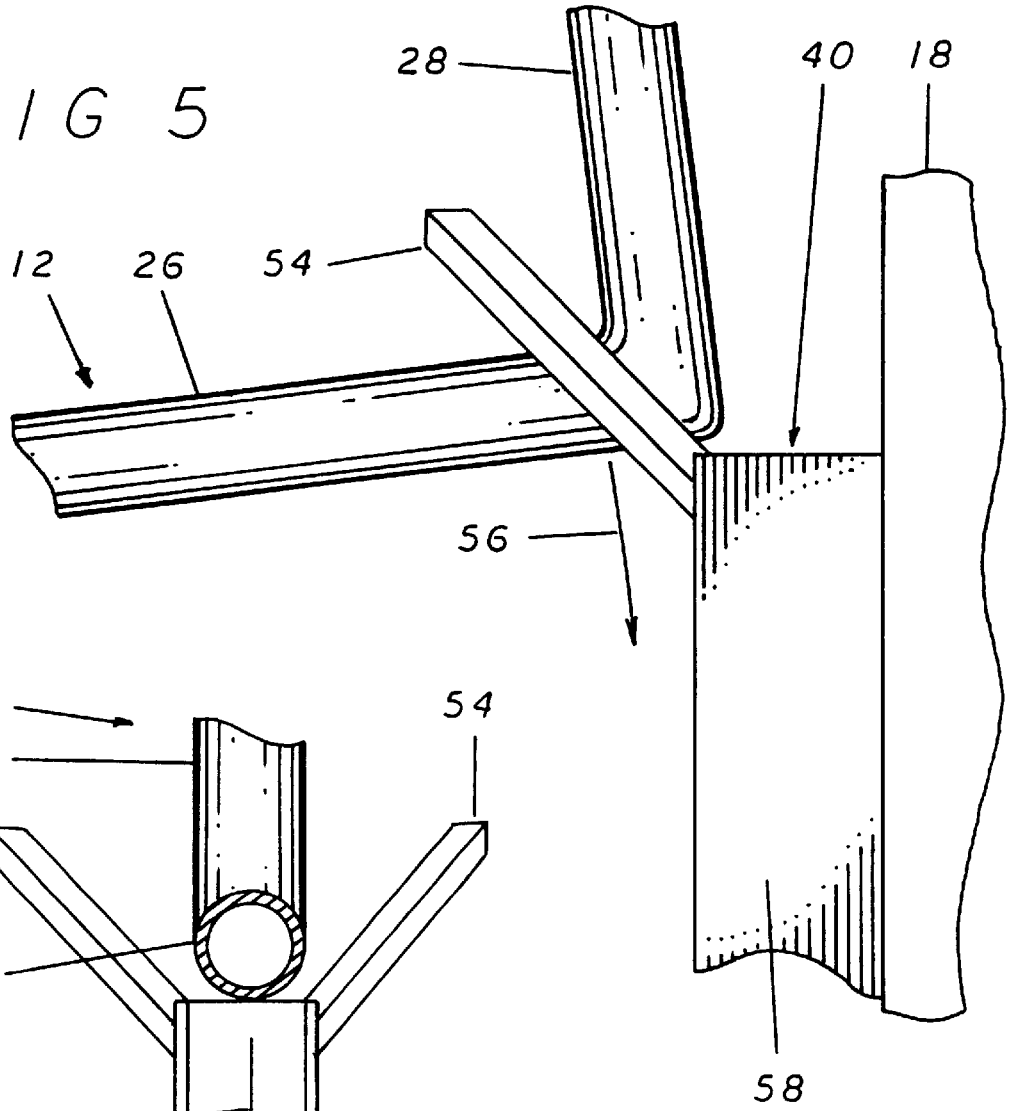
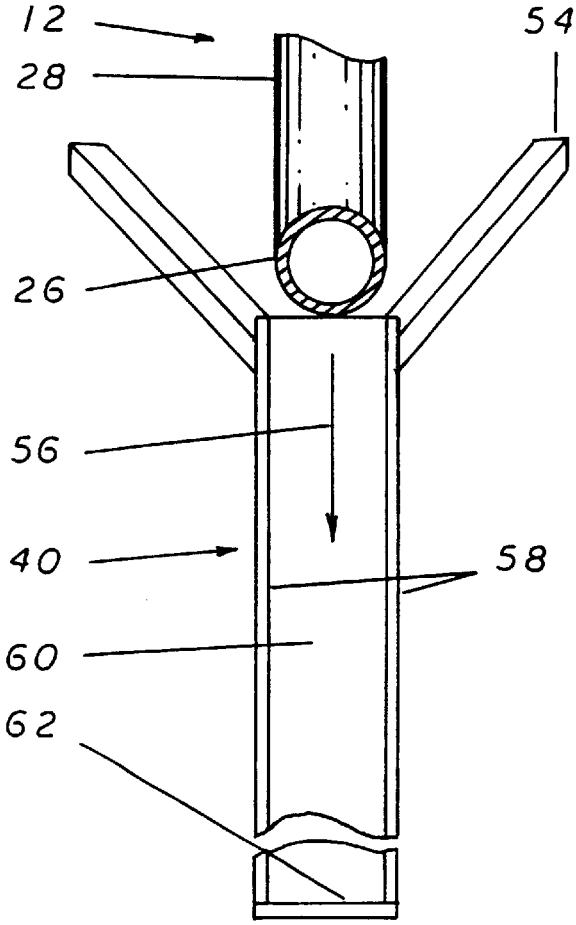
FIG 6

FIG 8
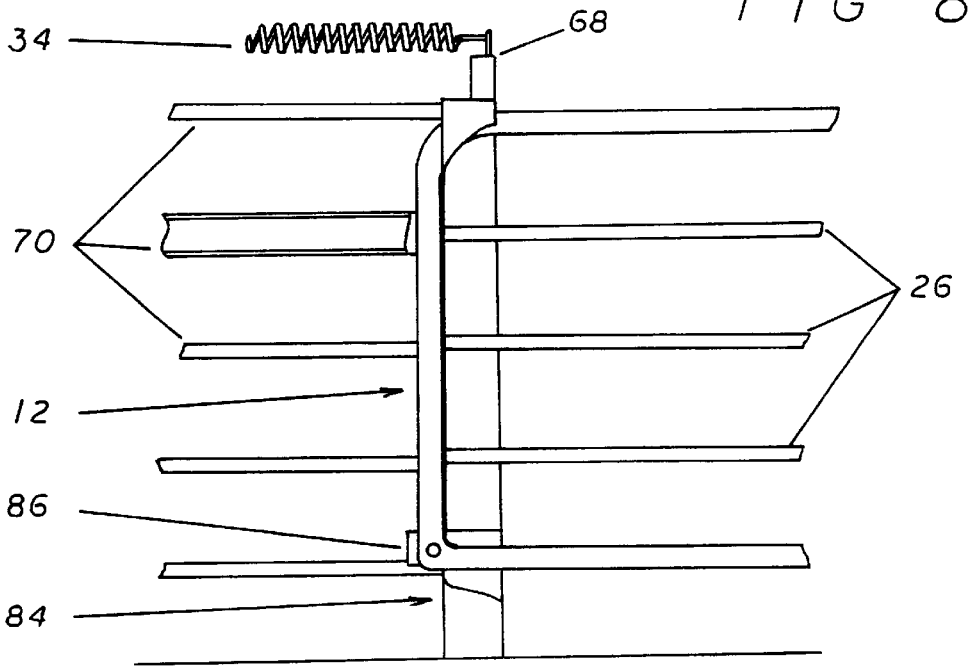
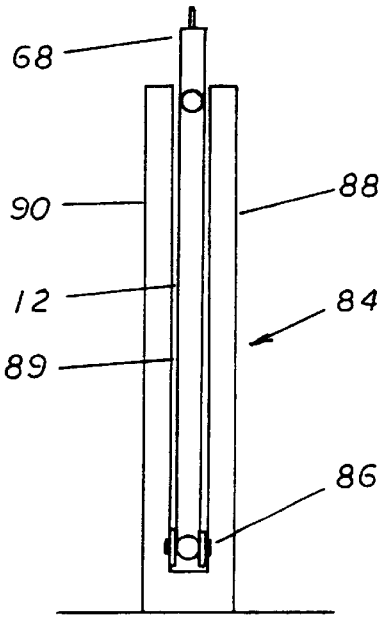
FIG 9
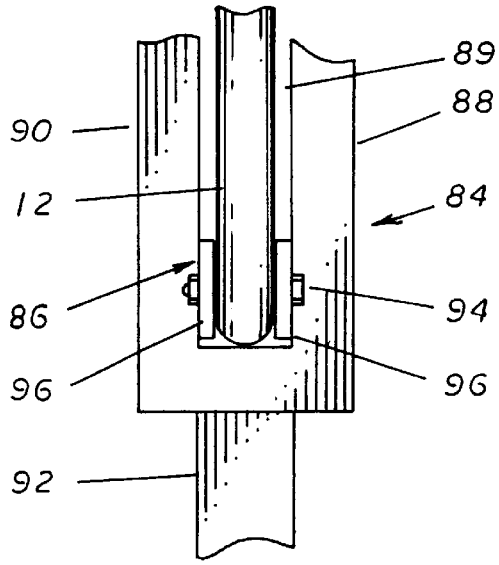
FIG 10

FIG 11
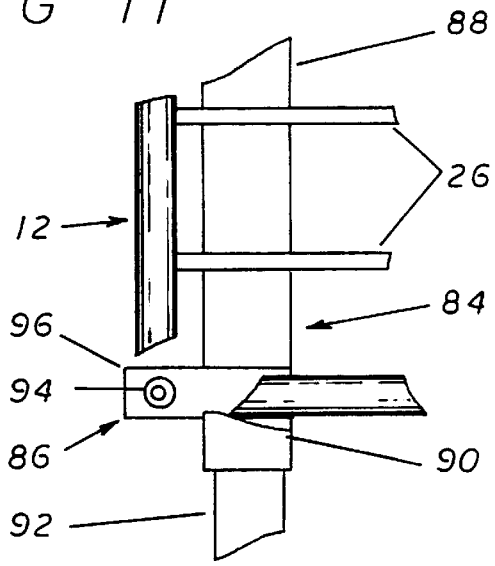
FIG 12
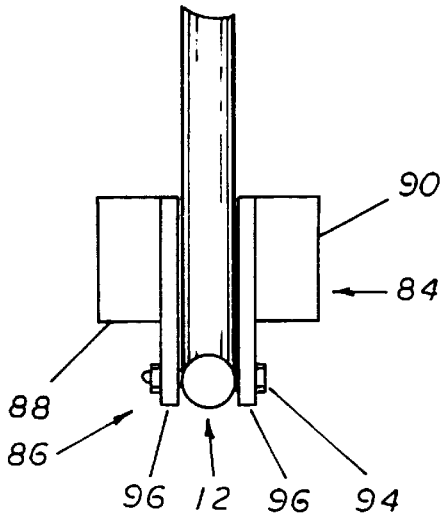
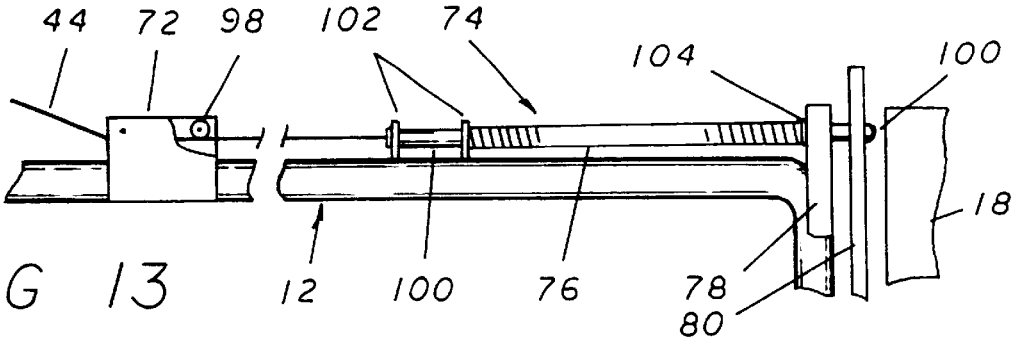
FIG 13
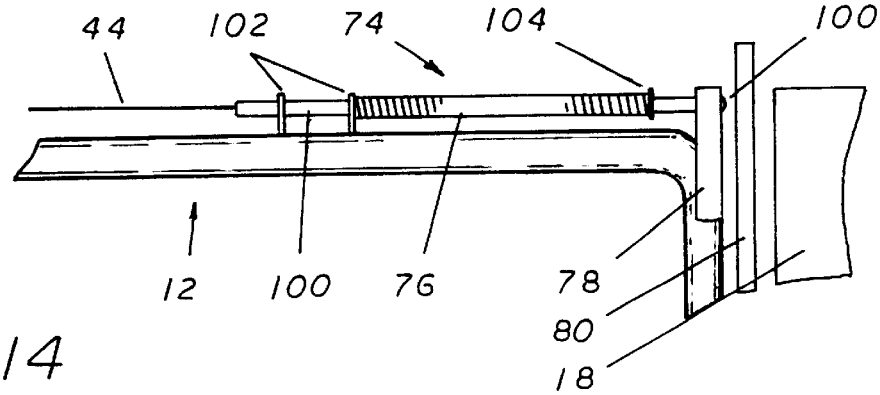
FIG 14

VERTICALLY OPENING GATE APPARATUS

BACKGROUND OF THE INVENTION

The present invention relates to a vertical lift gate used to control access to certain areas, roadways and corrals. More specifically, this invention relates to an electrically or manually powered vertical lift gate which may be activated manually or through the use of remote controls.

The use of a vertical style lift gate has been found to be advantageous in many situations where swinging gates can not be used for a variety of reasons, such as the presence of cattle, trees, landscaping, buildings or other obstructions that prevent the swinging of a gate. When used in a ranch or farm type setting, a typical gate requires a rancher to pull up, stop their tractor or pickup, exit the vehicle, open the gate, drive the vehicle through, once again exit the vehicle and close the gate. From this it can be seen that it would be advantageous to provide a gate that could be operated from within the vehicle or by a device easily carried in the pocket or belt of a worker, thus allowing easy access to gate areas, minimizing the amount of time a gate is open which can prevent the unwanted escape of livestock or entrance of other unwanted animals or people and promote a safe and efficient workplace.

Further, it can be seen that it would be necessary for this gate to securely lock and close when in the closed position and to easily be unlocked and opened either remotely or manually.

From this it can be seen that it would be advantageous to provide a gate that lifts vertically rather than swinging side to side and lifts on a simple mechanism that is both inexpensive to build and install as well as simple to maintain.

SUMMARY OF THE INVENTION

It is the primary objective of the present invention to provide a method by which a fence gate can be opened to allow for the passage of people, livestock, or machinery from one side of a fence-line to the other.

It is an additional objective of the present invention to provide such a method which clears the gate from the fence opening by lifting it around a pivot point in a vertical fashion which allows it to operate in a smaller area than the conventional swinging gate.

It is a further objective of the present invention of providing a method of opening wide span gates in a manner that will allow for its effective opening and closing and which reduces the stresses placed on its pivot point due to the width of the span of the gate.

It is a further objective of the present invention to provide such a method of clearing a fence opening which can be adapted to use a variety of energy sources, from hand cranked to electrically driven, to raise and lower the pivotally mounted gate.

It is a still further objective of the present invention to provide such a method of opening gates that can use remote activation devices, much like those used in garage door opener applications, which will allow the user to control the position of the gate from a remote location such as the driver's seat of his vehicle.

These objectives are accomplished by the use of a steel framed gate that is pivotally mounted at one of its lower corners to a specifically designed inner fence post which is securely positioned in the proper location within the ground. This method of pivotally mounting the gate allows one end of it to be swung up and out of the way thereby effectively opening the fence gap and allowing passage from one side of the fence line to the other. Additionally, the positioning of the pivotal mount on one of the lower corners of the gate ensures that as it is pivoted around the mount to the fully upright position, the body of the fence will entirely clear the fence gap which in turn allows for the clear passage through the fence line.

Outside of the inner fence post, in relation to the gate, is located the primary post which provides the point of attachment for the winch and other components which are necessary for the operation of the invention. The primary post is significantly taller than the inner post and this additional height adds a degree of leverage to the lifting and lowering of the gate as the winch device is mounted on this post at a relatively high location in relation to the upper surface of the gate. The winch is connected to the upper surface of the gate by the winch cable which is attached to the far upper corner of the gate. This arrangement of the winch in relation to its point of attachment to the gate provides the necessary leverage to the lifting mechanism to ensure for the proper operation of the invention. The space between the primary post and the inner post is spanned by the gate mesh which closes off that space and ensures that nothing can pass through the fence line between these components of the invention.

Additionally, the primary post provides the point of attachment for the upper end of the gate spring which spans the distance between the primary post and the upper corner of the gate that is located directly above the pivotal mount of the gate to the inner post. The purpose of the gate spring is to keep a certain degree of pressure on the gate as it passes through its range of motion in the opening and closing process. This pressure ensures that these processes operate smoothly through all stages of the present invention's opening and closing actions.

On the opposite side of the fence opening from the inner post is located the outer post. The outer post defines the dimensions of the fence opening and provides the point of attachment for the outer end of the gate when it is in the closed position. The closing mechanism is made up of a gate catch which engages and guides the edge of the gate as it is lowered into the closed position and holds it securely once the closed position has been properly obtained. Conversely, the open ended design of the upper end of the gate catch ensures that it will not interfere with the lifting of the gate during the opening operations.

The manner in which the operator of the present invention raises and lowers the gate depends largely on the power source used to drive the winch. In its simplest form there is simply a crank handle attached to the winch which the operator rotates to raise or lower the gate. While this method is effective, it can be laborious and requires that the operator approach the winch to operate it which may involve exiting a vehicle. A second manner of winch operation is to use electricity provided by a battery or by live feed electrical wires. This resolves the laborious aspect of the hand operated winch as the operator only needs to engage a switch to raise or lower the gate. Finally, the electrically driven winch can also be fitted with a sensing device much like those used with garage door openers which allow the operator to raise and lower the gate from remote locations such as the driver's seat of their vehicle which makes the operation of the invention as simple as possible.

The present invention can also employ a specially designed gate latch which is used to lock the gate in a downward and closed manner when the operator chooses to close off the gate opening. The gate latch is made up of a plunger that is horizontally mounted at the upper outside corner of the gate in a manner that allows it to slide laterally in relation to the upper surface of the gate. Additionally, the latch assembly incorporates the use of a compressible spring that is mounted in conjunction with the plunger and operates on it to force it outward in relation to the gate. The tip of the plunger in its most outward orientation engages the catch housing which is fixedly attached to the outer post on the far side of the gate opening. This positioning of the plunger serves to lock the gate to the outer post in the closed position where it will remain until the plunger is disengaged from its position of contact with the catch housing.

The gate latch is disengaged from the closed position by an inward force (in relation to the body of the gate) being placed on the plunger by the movement of the attached winch cable. This inward force serves to compress the spring and retract the plunger from the contact with the catch housing. With the plunger disengaged, the winch cable is then free to lift the gate out of the gate opening as described above. Conversely, when the gate is lowered back into the closed position, the resulting removal of the weight of the gate off of the winch cable allows the latch spring to force the plunger back into contact with the catch funnel which again locks the gate into the closed position across the gate opening.

An additional method of constructing the gate hinge is also available which employs the use of a dual slatted inner post which contains a gap into which the hinge is built and into which the gate fits in both the open and closed positions. The inner post gate hinge provides a more secure mounting for the gate than that provided by the previous embodiment which in turn provides a more durable and effective mechanism by which the gate can be opened and closed in conjunction with the stated purpose of the present invention.

For a better understanding of the present invention reference should be made to the drawings and the description in which there are illustrated and described preferred embodiments of the present invention.

DESCRIPTION OF THE DRAWINGS

FIG. 5 is a front elevation view of the gate catch component of the present invention illustrating the manner in which it engages the leading portion of the gate as it drops into place to close the fence opening.

FIG. 6 is a side elevation view of the gate catch component of the present invention illustrating the manner in which the catch prongs are used to guide the leading portion of the gate as it drops into the closed position.

FIG. 8 is a front elevation cut-away view of the double slat inner post component of an alternative embodiment the present invention illustrating the manner in which the gate fits within the inner post and the general manner of construction of the inner gate hinge.

FIG. 9 is a side elevation view of the double slat inner post component of an alternative embodiment of the present invention illustrating the manner in which the gate fits and is attached within the centrally located gap of the double slat inner post.

FIG. 10 is a close up side elevation view of the double slat inner post component of an alternative embodiment of the present invention illustrating the manner in which the gate fits and is attached within the centrally located gap of the double slat inner post.

FIG. 11 is a front elevation cut-away view of the connection of the gate to the inner gate hinge in the alternative embodiment of the present invention and details the hinge's manner of construction.

FIG. 12 is a side elevation cut-away view of the connection of the gate to the inner gate hinge in the alternative embodiment of the present invention and details the hinge's manner of construction.

FIG. 13 is a front elevation view of the gate latch assembly component of the alternative embodiment of the present invention illustrating the manner in which the plunger is used to engage the catch housing to lock the gate in a downward or closed orientation.

FIG. 14 is a front elevation view of the gate latch assembly component of the alternative embodiment of the present invention illustrating the manner in which the plunger is disengaged from its contact with the catch housing to release the gate and allow it to be drawn up to the open position.

DESCRIPTION OF THE PREFERRED EMBODIMENT

Figure 1:
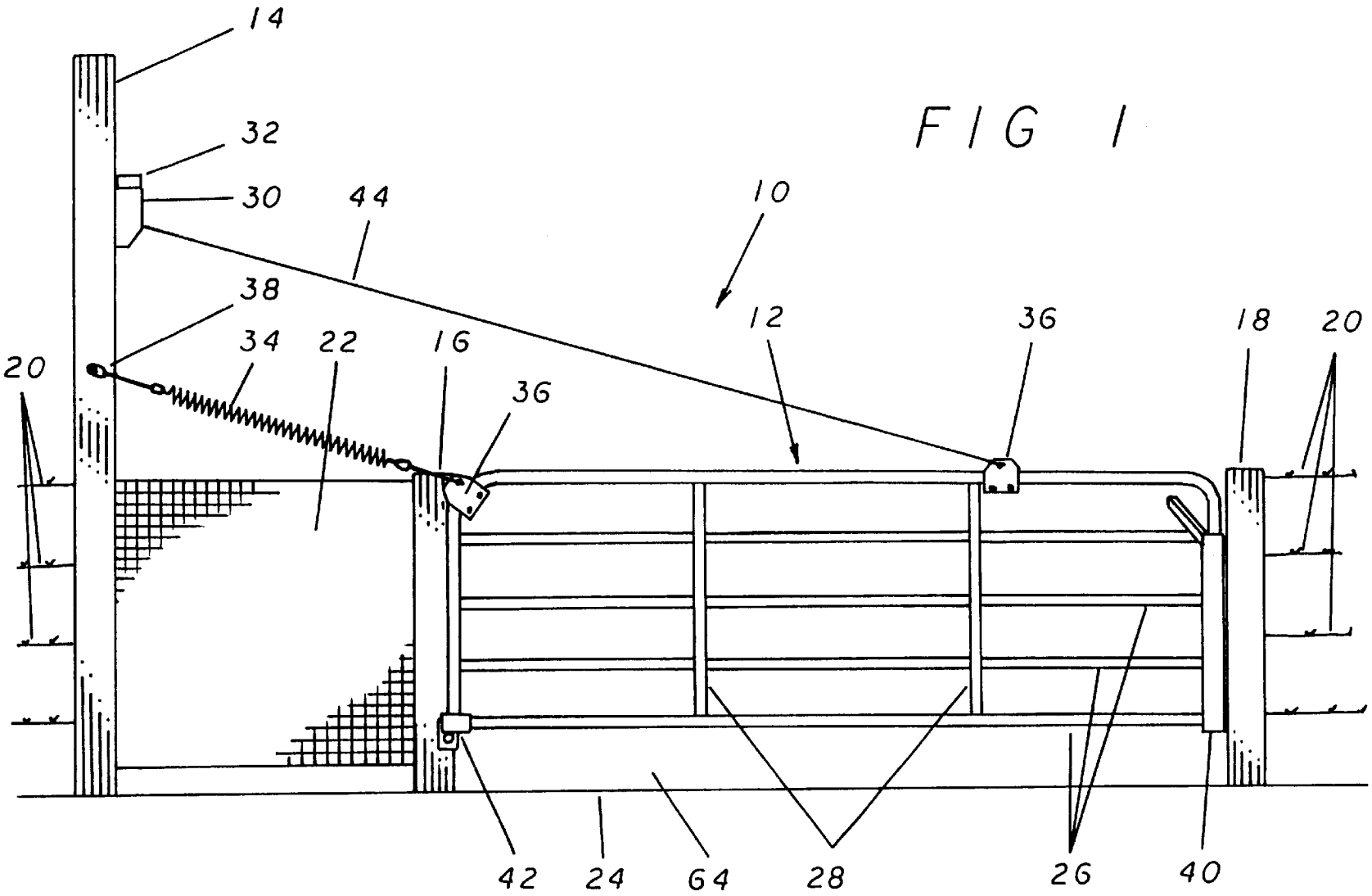
FIG. 1 is a front elevation view of the present invention which illustrates the manner in which it is employed in conjunction with a typical gate being used to close off a fence opening.
Figure 2:
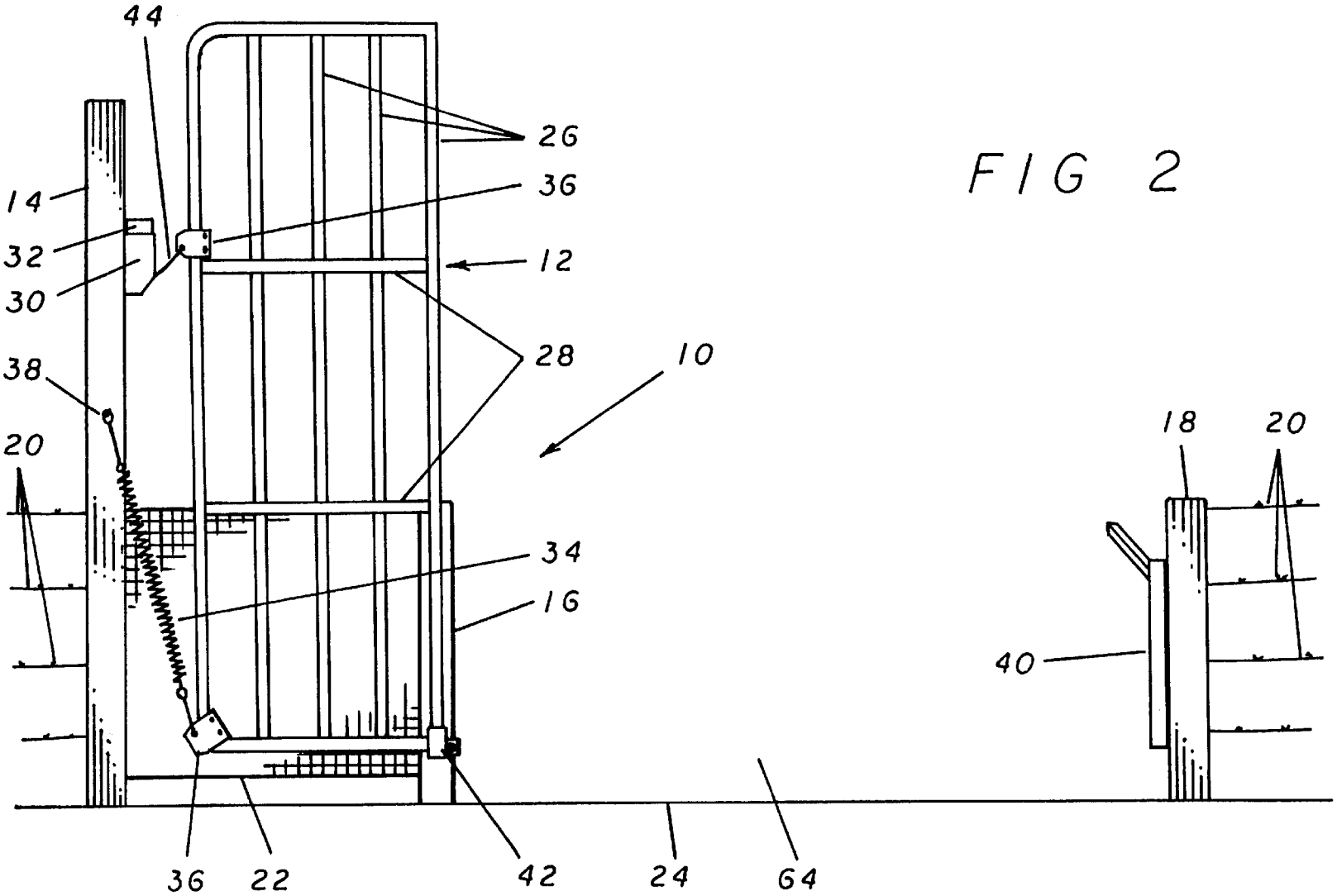
FIG. 2 is a front elevation view of the present invention which illustrates how the gate is pulled upward in a vertical manner to clear the fence opening to allow for the passage through the fence line.

Referring now to the drawings, and more specifically to FIGS. 1 and 2, the vertically opening gate apparatus 10 is made up of a gate 12 that is used to close a fence opening 64 of a typical fence 20. Fence openings 64 are a common feature of almost every fence 20 in use throughout the world as they allow objects to pass from one side of the fence 20 to the other. Additionally, these fence openings 64 are closed off by the use of a swinging gate 12 which is pivotally mounted to the fence 20 on one side of the fence opening 64 and can therefore be swung open or closed to allow or restrict passage depending upon the desire of the user.

With the present invention, the fence opening 64 is defined by the positioning of the inner post 16 and the outer post 18. The distance between is spanned by the gate 12 which is slightly shorter than the distance between the inner and outer posts, 16 and 18. The gate 12 is typically made of a framework of horizontal gate rails 26 and vertical gate rails 28 which are fastened together in a manner that will restrict the passage of specified objects from one side of the fence 20 to the other and as a whole runs just above and parallel to the surface of the ground 24. Additionally, the variance in the width of the gate 12 in relation to the fence opening allows the gate 12 to swing freely between the inner and outer posts, 16 and 18, during normal operations and for each of the components to independently adjust to changing temperatures without effecting the performance of the invention as a whole.

The present invention also employs the use of a primary post 14 which is located on the opposite side of the inner post 16 in relation to the location of the gate 12. Additionally, the primary post 14 is positioned so that the distance between ths primary post 14 and the inner post 16 is slightly more the distance between the bottom and top of the gate 12. This positioning is important as it allows for the free movement of the gate 12 during opening and closing operations. The gap between the inner post 16 and the primary post 14 is closed off by the use of the gate mesh 22 which maintains the integrity of the fence 20 without interfering with the operation of the gate 12.

The primary post 14 is implanted in the ground 24 in much the same manner as the inner and outer posts, 16 and 18, but is significantly taller than the other two. This additional height of the primary post 14 is significant as it also provides the point of attachment for the winch 30 which is the component of the present invention that is directly responsible for opening and closing the gate 12. The relatively high position of the winch 30 on the primary post 14 in relation to the inner post 16 is important as the angle created in the winch cable 44, used to lift and drop the gate 12, helps to create leverage which adds to the overall effectiveness of the winch 30. Additionally, the winch 30 is also commonly fitted with an opener sensor 32 which can be used to allow a user to activate the present invention from a remote location such as the driver's seat of his vehicle or other equipment.

The opening and closing operations of the gate 12 are controlled through the winch 30 by the winch cable 44 which extends from the winch 30 to the far corner of the gate 12 where it is attached through the use of a gate bracket 36. In the down or closed position, the front end of the gate 12 is engaged with the gate catch 40 located on the inner surface of the outer post 18. The activation of the winch 30 draws the winch cable 44 in which in turn lifts the far end of the gate 12 out of the gate catch 40 and forces the gate 12 as a whole to pivot around the gate hinge 42 located at its lower inner corner on the lower portion of the inner post 16. This pivoting action continues until the gate 12 obtains an orientation in which is upper edge is generally perpendicular to the inner surface of the primary post 14. With the gate 12 in this upright position the fence opening 64 is clear and objects are left to freely pass from one side of the fence 20 to the other.

The primary post 14 also provides the point of attachment for the upper end of the gate spring 34 by the use of the upper spring mount 38. Additionally, the lower end of the gate spring 34 is connected to the upper inside corner of the gate 12 through the use of a gate bracket 36 much like that used to attach the winch cable 44. The purpose of the gate spring 34 is to place a degree of tension on the gate 12 in the opening and closing processes which ensures that the gate 12 will move easily and smoothly through its intended functions.

With reference to the function of the gate spring 34, it is tensioned when the gate 12 is in its down position which has the effect of placing a force upon the inside upper corner of the gate 12 which would tend to help it open. Conversely, when the gate is open, the gate spring is tensioned in a manner which places a force on the inside upper corner of the gate 12 which would tend to help it return to the closed position. This transition in the force applied by the gate spring 34 is a function of the placement of its upper end on the primary post 14. That is to say, the point of gate spring 34 attachment on the gate 12 moves through an arch during the opening and closing process with the apex of that arch being at its closest point to the upper spring mount 38 at the midway point between the gate 12 being fully open and fully closed. Any further movement away from this midway point in either direction tensions the gate spring 34 which therefore aids in the opening or closing process respectively.

Figure 3:
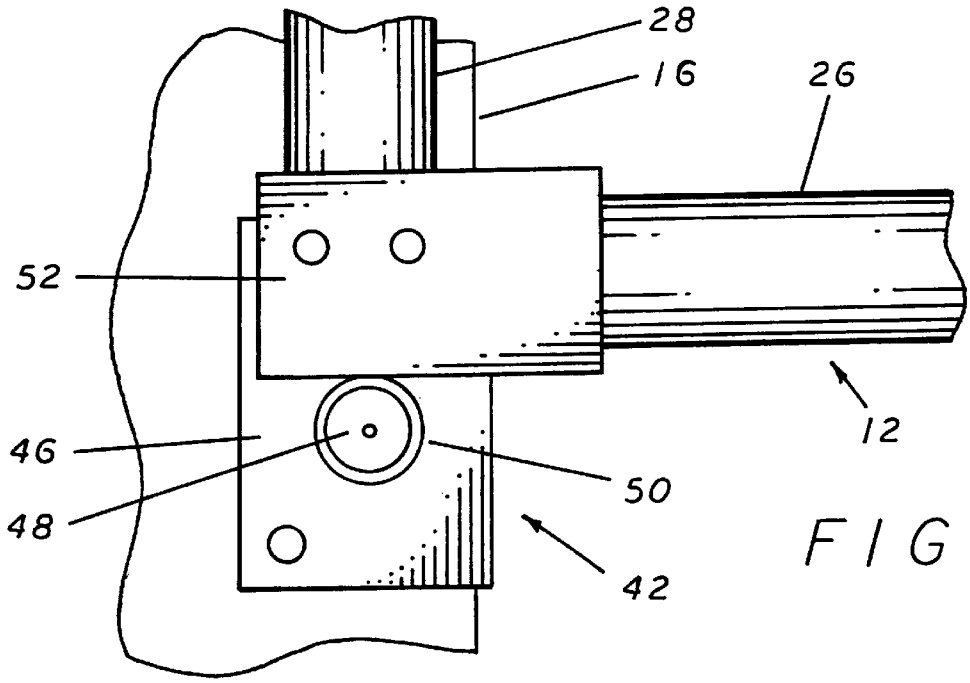
FIG. 3 is a front elevation view of the gate hinge component of the present invention illustrating its general manner of construction.
Figure 4:
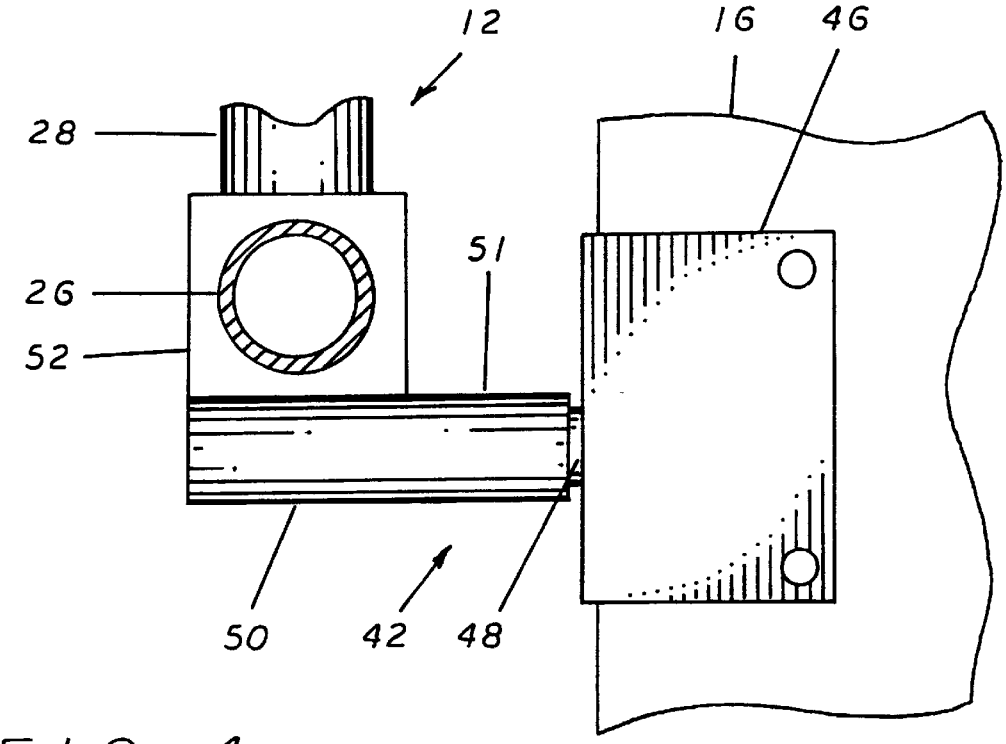
FIG. 4 is a side elevation view of the gate hinge component of the present invention illustrating the manner in which the sleeve shoulder is employed to keep the gate at a specified distance from the fence posts which enables the gate to move freely within its designed parameters.

The manner of construction of the gate hinge 42 component of the present invention is further detailed in FIGS. 3 and 4. The gate hinge 42 is the component of the invention which both attaches the gate 12 to the inner post 16 and allows it to pivot between the open and closed position which is the primary function of a gate 12. The gate hinge 42 is made up of two primary components. The first of these is the hinge mount bracket 46 which is generally a section of V-shaped metal that fits over the corner of the inner post 16. This is the point of attachment which fastens the gate 12 in the desired location within the invention. Additionally, the hinge mount bracket 46 has a perpendicularly extending hinge mount pin 48 from its outwardly oriented (in relation to the inner post 16) surface which allows for the mounting of the gate corner 52 to the hinge mount bracket 46.

The second primary component of the gate hinge 42 is the gate corner 52 which serves to pivotally attach the gate 12 to the hinge mount bracket 46. The gate corner 52 is generally a block which encloses the joint of the horizontal and vertical gate rails, 26 and 28, and which has attached to its lower surface a pin sleeve 50. The pin sleeve 50 is a tube-like apparatus which has an inside diameter that is slightly larger than the outside diameter of the hinge mount pin 48. The connection is made by slipping the pin sleeve 50 over the hinge mount pin 48 and retaining it there in a manner that allows it to pivot freely around the hinge mount pin 48. Thus, the gate hinge 42 attaches the gate 12 to the inner post 16 that allows it to pivot in its vertical axis.

Additionally, the pin sleeve 50 has a sleeve shoulder 51 which is simply a portion of the pin sleeve 50 that extends beyond the inner surface of the gate corner 52 in relation to the hinge mount bracket 46. The purpose of the sleeve shoulder 51 is to provide a degree of separation between the gate 12 and the inner post 16. This gap allows the gate 12 to pivot freely during the opening and closing operations without contacting the inner post 16. Thus, the sleeve shoulder 51 allows the gate 12 to move freely without interference from the other components of the invention.

The manner of construction and the method of operation of the gate catch 40 are further detailed in FIGS. 5 an 6. As previously stated, the gate catch 40 is attached to the inner surface of the outer post 18 in a position that ensures it will engage the gate 12 as it is lowered into the closed position. In furtherance of its purpose of directing and holding the closed gate 12, the upper end of the gate catch 40 is equipped with a pair oppositely oriented diagonally extending catch prongs 54 which serve to direct a lowering gate 12 that is slightly offline into the centrally located catch channel 60 of the gate catch 40. The catch channel 60 is enclosed by the catch sides 58 Which maintain the gate 12 within the gate catch 40 when it is closed. Finally, the downward gate travel 56 is effectively limited by the gate stop 62 which closes off the bottom of the gate catch 40. Therefore, when the gate 12 is in its closed position it rests on the gate stop 62 between the catch sides 58 of the gate catch 40 which hold it in the proper location until the gate is opened at a later time.

Figure 7:
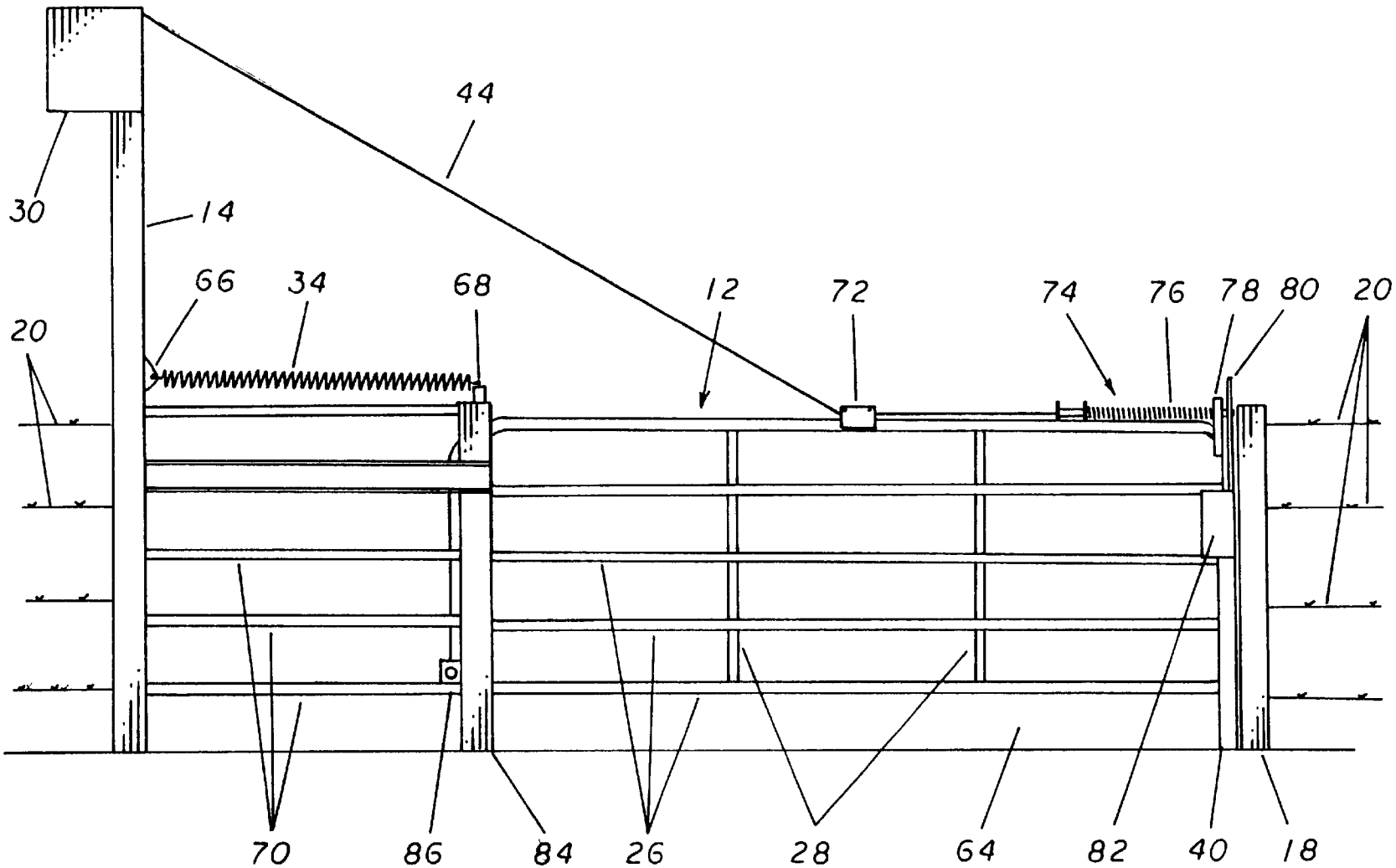
FIG. 7 is a front elevation view of an alternative embodiment of the present invention which illustrates the manner in which it is employed in conjunction with a typical gate being used to off close a fence opening.

An alternative embodiment of the present invention is also provided which employs a different method of pivotally attaching the gate 12 to the remaining components of the vertically opening gate apparatus 10. This embodiment of the present invention is constructed in much the same fashion as the previous embodiment which is illustrated in FIG. 7 and therefore also operates in much the same manner. However, the alternative embodiment utilizes a double slat inner post 84 in place of the inner post 16 of the previous. Additionally, in conjunction with the double slat inner post 84, the present embodiment uses an inner gate hinge 86 to pivotally attach the gate 12 within the fence opening 64.

The general manner of construction of the double slat inner post 84 and the inner gate hinge 86, as well as many other components of this embodiment of the invention, are further detailed in FIGS. 8, 9, 10, 11, and 12. The double slat inner post 84 is made up of two parallel members, the inner and outer slats, 88 and 90, which are separated by an interior gap 89. The double slat inner post 84 also contains a downwardly extending post mount 92 which is used to anchor the double slat inner post 84 to the ground. This serves to orient the double slat inner post 84 in a vertical fashion which provides a solid base onto which the remaining components of this embodiment of the present invention can be attached.

The inner gate hinge 86 fits within the lower portion of the interior gap 89 between the inner and outer slats, 88 and 90, and is itself made up of two parallel oriented hinge brackets 96 that are each separately mounted to the inside of the inner and outer slats, 88 and 90. This method of construction allows the lower corner of the gate 12 to be placed between the hinge brackets 96 and pivotally positioned there by the use of the pivot bolt 94 which passes through this arrangement from the outside surface of one of the hinge brackets 96 to the outside surface of the other. This configuration provides a solid mounting for the gate 12 which allows it to freely pivot allowing it to swing open and closed as dictated by the design of this and other embodiments of the present invention.

This embodiment of the present invention also employs the use of gate spring 34 in much the same manner as the previous embodiment which is used to aid in the opening and closing processes of the gate 12. The primary difference is that this embodiment uses an upper and lower spring brackets, 66 and 68, which are located in slightly different positions on the components of the invention which enhances the overall performance of the gate spring 34. Additionally, these FIGS. also illustrate the use of a plurality of fence bars 70 that are used to close off the space between the double slat inner post 84 and the primary post 14 as opposed to the gate mesh 22 that was used in the previous embodiment.

This embodiment of the present invention is also illustrated in FIGS. 13 and 14 using a gate latch assembly 74 which is employed to lock the gate 12 in the downward position in which the fence opening 64 is closed off. The gate latch assembly 74 is positioned on the upper corner of the body of the gate 12 in a location that allows it to interact with components positioned on the outer post 18. The gate latch assembly 74 is operated by its connection with the winch cable 44 which is in turn connected to the winch 30 through the cable idler bracket 72 located about midway in the body of the gate 12. The cable idler bracket 72 is equipped with a pair of cable idler wheels 98 which engage the winch cable 44 as it passes through the cable idler bracket 72. The use of the cable idlers wheels 98 allows the direction of travel of the winch cable 44 to change from the diagonal orientation it assumes between the winch 30 and the cable idler bracket 72 to the horizontal orientation (in relation to the upper surface of the gate 12) it assumes between the cable idler bracket 72 and the gate latch assembly 74. This system allows the winch cable 44 to be manipulated to operate the gate latch assembly 74 and to raise and lower the gate 12 in a smooth manner that allows the invention to operate as designed.

The gate latch assembly 74 is made up of a gate latch plunger 100 that is horizontally mounted at the upper corner of the gate 12 by the use of the two vertically oriented plunger mount tabs 102 located on the inner end of the gate latch plunger 100 on the upper surface of the gate 12 and also at its outer end by the vertical latch bracket 78. The gate latch plunger 100 is also fitted with a latch spring 76 which encircles it between the plunger mounts tabs 102 and the spring stop 104 which, under normal circumstances, rests against the inner surface of the vertical latch bracket 78.

The positioning of the latch spring 76 between the plunger mounts tabs 102 and the spring stop 104 places a load on the latch spring 76 which in turn operates to force the gate latch plunger 100 in an outward manner in relation to the upper surface of the gate 12. In this orientation, the gate latch plunger 100 extends beyond the outward edge of the vertical latch bracket 78. This allows it to engage the catch housing 80 which is a component of the gate catch 40 that extends above the catch funnel 82 used to guide the gate 12 into the proper position during the closing phase of the present invention's operations.

During gate 12 opening procedures, the winch cable 44 is retracted which in turn draws out the gate latch plunger 100 and compresses the latch spring 76 (a condition which is illustrated in FIG. 14). The compression of the latch spring 76 is accomplished because the spring stop 104 is pulled back with the gate latch plunger 100 which compresses the latch spring 76 against the plunger mounts tabs 102. The resulting increase in the amount of load that is placed on the gate latch spring 76 ensures that when the tension of the winch cable 44 is released it will return to its extended position where it can engage the catch housing 80 to ensure that the gate 12 will remain in the desired closed position.

Although the present invention has been described in considerable detail with reference to certain preferred versions thereof, other versions are possible. Therefore, the spirit and scope of the appended claims should not be limited to the description of the preferred versions contained herein.

What is claimed:

1. A vertically opening gate apparatus comprising:

a rectangular gate section having an upper edge with a hinge corner and a locking corner, a lower edge with a hinge corner and a locking corner, and a hinge side and a locking side;

an inner elongate post section having a gate hinge pivotally attaching said inner elongate post section to the hinge corner of said lower edge of said rectangular gate section such that said gate section can pivot between a down and closed position and an up and open position;

an elongate primary gate post spaced away from said inner elongate post section, said elongate primary post having height greater than that of said inner elongate post section;

a locking means on said locking side of said rectangular gate section for securing said gate section when in said down and closed position;

a gate spring mounted to said upper edge hinge corner and said elongate primary post in a position above said upper edge hinge corner and above said inner elongated post section such that an upward bias is placed on the upper edge of said rectangular gate section; and a winch cable for rasing and lowering said rectangular gate section, said winch cable having a first end attached to said upper edge of said rectangular gate section.

2. A vertically opening gate apparatus as in claim 1 further comprising:

a winch attached to said elongate primary gate post, said winch cable having a second end attached to said winch.

3. A vertically opening gate apparatus as in claim 2 further comprising a fence section attached to said inner elongate post section and said elongate primary gate post.

4. A vertically opening gate apparatus as in claim 3 further comprising a manually operated crank for turning said winch.

5. A vertically opening gate apparatus as in claim 3 further comprising a powered motor for turning said winch.

6. A vertically opening gate apparatus as in claim 5 further comprising a remote control for activating said powered motor.

7. A vertically opening gate apparatus as in claim 6 wherein said locking means comprises a V shaped catch prong.

8. A vertically opening gate apparatus as in claim 5 wherein said locking means is a spring loaded locking bolt attached to said cable such that tension on said cable releases said bolt.

9. A vertically opening gate apparatus comprising:

an elongate primary post, an elongate outer post and an inner elongate post between said elongate primary post and said elongate outer post;

a rectangular gate section having an upper edge with a hinge corner and a locking corner, a lower edge with a hinge corner and a locking corner, and a hinge side and a locking side;

a gate hinge pivotally attaching said inner elongate post to the hinge corner of said lower edge of said rectangular gate section such that said rectangular gate section can pivot between a down and closed position and an up and open position;

a locking bolt for securing said rectangular gate section when in said down and closed position;

a gate spring mounted to said upper edge hinge corner and said elongate primary post in a position above said upper edge hinge corner and above said inner elongate post such that an upward bias is placed on the upper edge of said rectangular gate section; and a winch cable for rasing and lowering said rectangular gate section, said cable having a first end attached to said upper edge of said rectangular gate section.

10. A vertically opening gate apparatus as in claim 9 further comprising a winch attached to said elongate primary post, said winch cable having a second end attached to said winch.

11. A vertically opening gate apparatus as in claim 10 further comprising a fence section attached to said inner elongate post and said elongate primary post.

12. A vertically opening gate apparatus as in claim 11 further comprising a manually operated crank for turning said winch.

13. A vertically opening gate apparatus as in claim 11 further comprising a powered motor for turning said winch.

14. A vertically opening gate apparatus as in claim 13 further comprising a remote control for activating said powered motor.

15. A vertically opening gate apparatus as in claim 14 wherein said locking bolt is spring loaded and attached to said cable such that tension on said cable releases said bolt.

16. A vertically opening gate apparatus comprising:

an elongate primary post, an elongate outer post and an inner elongate split post between said elongate primary post and said elongate outer post;

a rectangular gate section having an upper edge with a hinge corner and a locking corner, a lower edge with a hinge corner and a locking corner, and a hinge side and a locking side;

a gate hinge pivotally attaching said inner elongate split post to the hinge corner of said lower edge of said rectangular gate section such that said rectangular gate section can pivot between a down and closed position and an up and open position;

a spring loaded locking bolt for securing said rectangular gate section to said elongate outer post when in said down and closed position;

a gate spring mounted to said upper edge hinge corner and said elongate primary post in a position above said upper edge hinge corner and above said inner elongate split post such that an upward bias is placed on the upper edge of said rectangular gate section; and a winch cable for rasing and lowering said rectangular gate section, said cable having a first end attached to said spring loaded locking bolt.

17. A vertically opening gate apparatus as in claim 16 further comprising a winch attached to said elongate primary post, said winch cable having a second end attached to said winch.

18. A vertically opening gate apparatus as in claim 17 further comprising a fence section attached to said inner elongate post and said elongate primary post.

19. A vertically opening gate apparatus as in claim 18 further comprising a manually operated crank for turning said winch.

20. A vertically opening gate apparatus as in claim 18 further comprising:

a powered motor for turning said winch; and a remote control for activating said powered motor.

* * * * *